US009518574B2

(12) United States Patent
Tobe

(10) Patent No.: US 9,518,574 B2
(45) Date of Patent: Dec. 13, 2016

(54) SUCTION MUFFLER FOR COMPRESSOR

(75) Inventor: Takahisa Tobe, Isesaki (JP)

(73) Assignee: SANDEN HOLDINGS CORPORATION, Isesaki-shi (JP)

( * ) Notice: Subject to any disclaimer, the term of this patent is extended or adjusted under 35 U.S.C. 154(b) by 232 days.

(21) Appl. No.: 14/125,018

(22) PCT Filed: Jun. 8, 2012

(86) PCT No.: PCT/JP2012/064795

§ 371 (c)(1),
(2), (4) Date: Dec. 9, 2013

(87) PCT Pub. No.: WO2012/169615

PCT Pub. Date: Dec. 13, 2012

(65) Prior Publication Data

US 2014/0105762 A1 Apr. 17, 2014

(30) Foreign Application Priority Data

Jun. 10, 2011 (JP) ..... 2011-129842

(51) Int. Cl.
*F04B 39/04* (2006.01)
*F04B 39/00* (2006.01)
*F04B 39/02* (2006.01)

(52) U.S. Cl.
CPC ..... *F04B 39/0072* (2013.01); *F04B 39/0061* (2013.01); *F04B 39/023* (2013.01); *F04B 39/04* (2013.01)

(58) Field of Classification Search
CPC ..... F04B 11/00; F04B 53/001; F04B 53/004; F04B 39/0072; F04B 39/023; F04B 39/0061; F04B 39/04
(Continued)

(56) References Cited

U.S. PATENT DOCUMENTS

RE33,902 E * 4/1992 Fritchman ..... F04B 39/125 181/403
5,201,640 A 4/1993 Heinzelmann et al.
(Continued)

FOREIGN PATENT DOCUMENTS

CN 1067097 12/1992
CN 1125920 10/2003
(Continued)

OTHER PUBLICATIONS

Office Action (and a partial English translation) dated Feb. 4, 2014 issued in the corresponding Japanese Patent Application No. 2011-129842.

*Primary Examiner* — Charles Freay
*Assistant Examiner* — Philip Stimpert
(74) *Attorney, Agent, or Firm* — Cozen O'Connor

(57) ABSTRACT

To prevent oil from being drawn into a suction muffler of a compressor, a suction muffler 7 is disposed in a compressor casing at an inlet of a compression chamber at an upstream side of a refrigerant passage and positioned so that the suction muffler 7 receives oil, in which an upper lid member 71, and a lower lid member 72 having a bottom wall to which refrigerant introducing and leading-out pipes 8, 72*d* are connected, are fitted and secured by bringing an inner face of a side wall of the member 71 into tight contact with an outer face of a side wall of the member 72, and a protruding portion 72*f* is provided by forming a lower end of side wall of the member 71 to protrude below a lower face of bottom wall of the member 72, to surround connecting portions of the pipes 8, 72*d*.

6 Claims, 4 Drawing Sheets

(58) Field of Classification Search
USPC ..... 417/312; 181/403
See application file for complete search history.

(56) References Cited

U.S. PATENT DOCUMENTS

| | | | | |
|---|---|---|---|---|
| 5,288,212 | A * | 2/1994 | Lee | F04B 39/125 181/229 |
| 2001/0050198 | A1 | 12/2001 | An et al. | |
| 2002/0017425 | A1* | 2/2002 | Yoon | F04B 39/0061 181/292 |
| 2002/0185178 | A1* | 12/2002 | Kobayashi | F25B 41/062 137/454.2 |
| 2005/0100456 | A1 | 5/2005 | Osaka et al. | |

FOREIGN PATENT DOCUMENTS

| | | |
|---|---|---|
| CN | 1494636 | 5/2004 |
| CN | 2833127 | 11/2006 |
| CN | 100392243 | 6/2008 |
| CN | 101196183 | 6/2008 |
| JP | 172668/1980 | 12/1980 |
| JP | 03-141879 | 6/1991 |
| JP | 5-195953 | 8/1993 |
| JP | 2005-113926 | 4/2005 |
| JP | 2007-239633 | 9/2007 |

* cited by examiner

SUCTION MUFFLER FOR COMPRESSOR

RELATED APPLICATIONS

This application is a U.S. National Phase Application under 35 U.S.C. 371 of International Application PCT/JP2012/064795 filed Jun. 8, 2012.

This application claims the priority of Japanese application No. 2011-129842 filed Jun. 10, 2011, the entire content of which is hereby incorporated by reference.

TECHNICAL FIELD

The present invention relates to a suction muffler for noise reduction, which is disposed in a compressor casing at an inlet of a compression chamber on an upstream side of a refrigerant passage.

BACKGROUND ART

In general, a suction muffler is disposed at a location at which the suction muffler can receive oil for lubrication and cooling, which is sprayed from above in the compressor casing.

When the oil is drawn into the suction muffler, the temperature of a refrigerant gas that is drawn into the suction muffler may be increased, decreasing the density of the refrigerant, and thus, refrigeration capacity may be decreased.

Furthermore, when an amount of the drawn oil increases, oil escaping from a discharging side to a system side which is outside the compressor may be increased, so that lubrication in a driving unit of the compressor may be insufficient and thermal efficiency may be decreased due to attachment of the oil inside a heat exchanger of a cooling circuit, and thus, performance and reliability may be decreased.

Thus, according to the Patent Document 1, in order to prevent the oil adhering to a wall face of the suction muffler from entering into a lower refrigerant suction port, an enclosing member is secured to a casing of the suction muffler.

CITATION LIST

Patent Document

Patent Document 1: Japanese Laid-open Patent Application Publication No. H03-141879

SUMMARY OF THE INVENTION

Problems to be Solved by the Invention

However, such a configuration provided with the enclosing member for preventing the oil from being drawn may complicate a shape of the muffler and may cause increase in cost.

Furthermore, since a body of the suction muffler is formed by two divided members and the divided members are secured to each other by welding, a welding machine and a welding process are required, so that costs may be further increased.

The present invention has been achieved in view of such conventional problems, and an object of the present invention is to provide a suction muffler for a compressor, which has a simple structure, allowing cost to be reduced and oil can be effectively prevented from being drawn in.

Means for Solving the Problems

In view of this, the present invention is a suction muffler which is disposed in a compressor casing at an inlet of a compression chamber on an upstream side of a refrigerant passage and is disposed at a location at which the suction muffler receives oil sprayed from above in the casing, and it is configured as follows.

An introducing pipe and a leading-out pipe of a refrigerant are connected upward to the suction muffler from beneath the suction muffler, and at an outside of connecting portions of the introducing pipe and the leading-out pipe of the refrigerant, each of which is connected to the suction muffler, a protruding portion which protrudes below the connecting portions and surrounds the connecting portions is provided.

Effect of the Invention

Even when the suction muffler receives the oil sprayed from above, since the outside of the connecting portions of the introducing pipe and the leading-out pipe of the refrigerant, each of which is connected to the suction muffler, are surrounded by the protruding portion, the oil can drip from a lower end of the protruding portion, and thus, the oil can be prevented from being drawn into the introducing pipe and the leading-out pipe of the refrigerant.

MODE FOR CARRYING OUT THE INVENTION

Hereunder, a compressor provided with a suction muffler according to embodiments of the present invention will be described with reference to the accompanying drawings.

Figure 1:
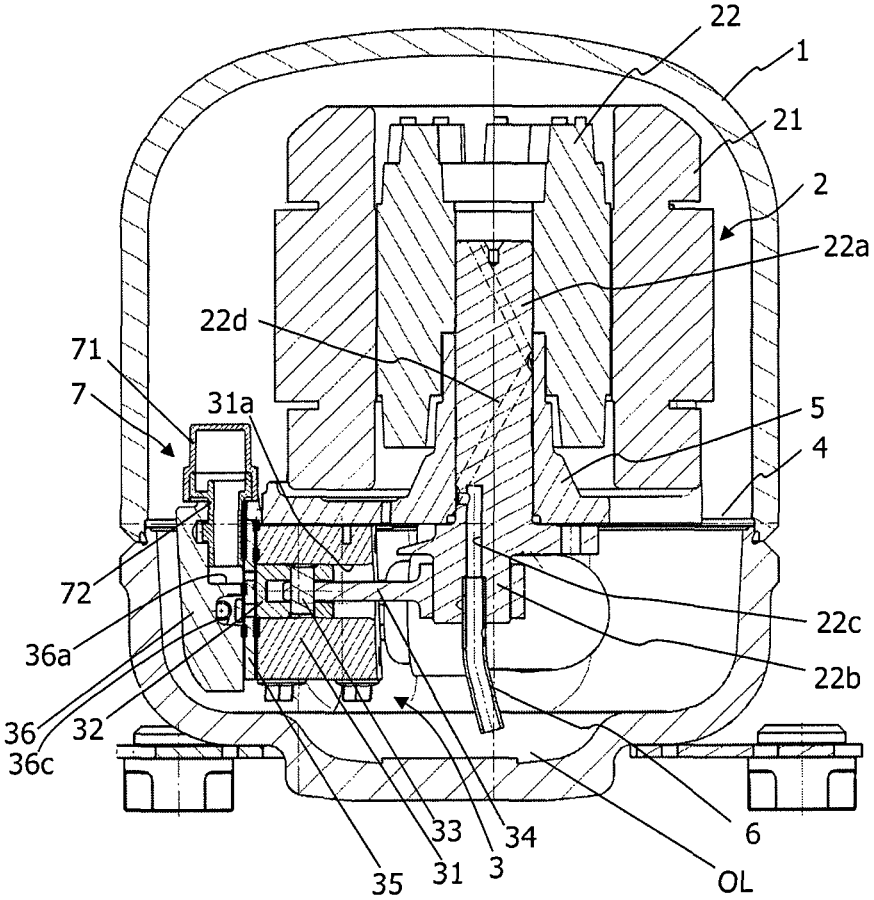
FIG. 1 is a longitudinal cross-sectional view illustrating a compressor provided with a suction muffler according to an embodiment of the present invention.
Figure 2:
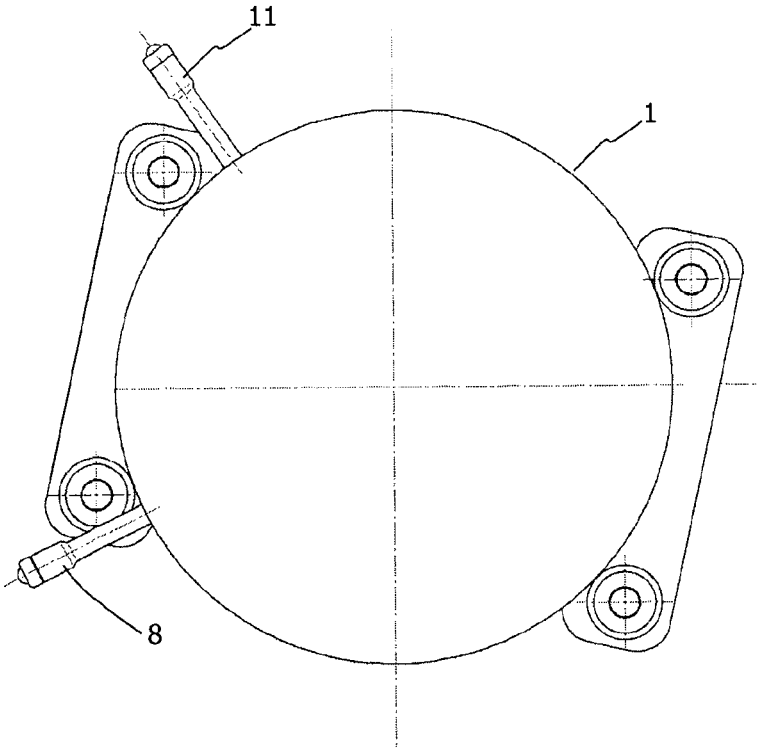
FIG. 2 is a plan view illustrating the compressor.
Figure 3:
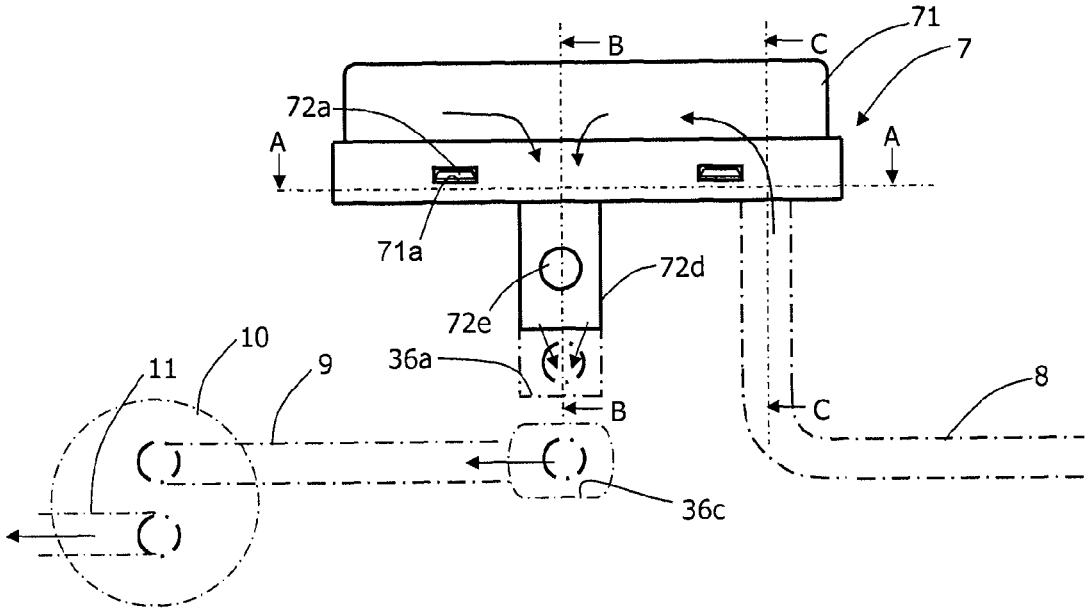
FIG. 3 is a front view illustrating the enlarged suction muffler.
Figure 4:
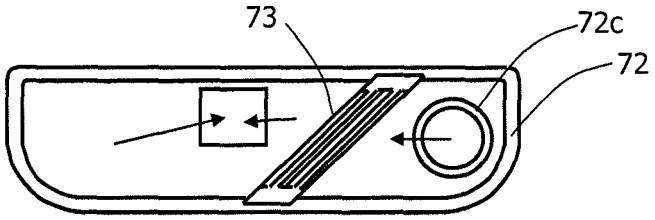
FIG. 4 is a cross-sectional view taken along with a line A-A of FIG. 3.
Figure 5:
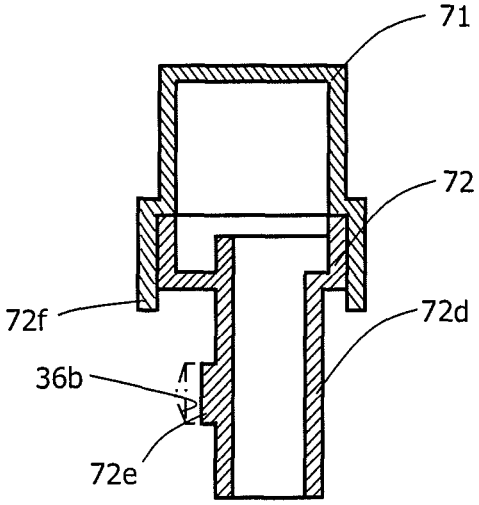
FIG. 5 is a cross-sectional view taken along with a line B-B of FIG. 3.
Figure 6:
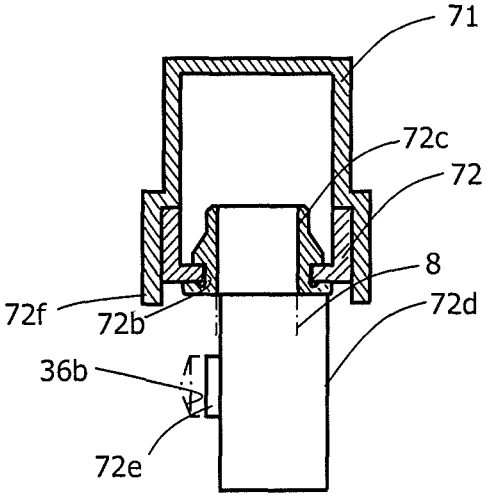
FIG. 6 is a cross-sectional view taken along with a line C-C of FIG. 3.

Referring to FIG. 1 and FIG. 2, which are a longitudinal cross-sectional view and a plan view of the compressor, respectively, in a casing 1, a motor 2 and a compression mechanism 3 driven by the motor 2 are supported via a support plate 4, and oil OL is stored in a bottom of the casing 1.

The motor 2 are provided with a stator 21 and a rotor 22. A rotor shaft 22*a* extending in the vertical direction in a center of the rotor 22 is borne by a bearing member 5 secured to a lower face of the stator 21.

The rotor shaft 22*a* is formed in a shape of a crankshaft having an eccentric portion 22*b*, which has a center axis shifted from a rotation center axis, at a portion protruding below the bearing member 5.

At the eccentric portion 22*b*, an oil hole 22*c* is formed along the center axis of the eccentric portion 22*b*. To the oil hole 22*c*, an upper end of a feed oil pipe 6, a lower end of which is put in the stored oil OL, is press-fitted and secured. The feed oil pipe 6 is formed to be bent so that the lower end thereof is positioned near the rotation center axis.

An upper portion of the oil hole 22*c* is formed to be extended above the eccentric portion 22*b*, and an upper end of the oil hole 22*c* communicates with a lower end of an oil groove 22*d* which is helically formed along an outer peripheral surface of the rotor shaft 22*a*. The oil groove 22*d* is formed so that an upper end thereof is opened on an upper end face of the rotor shaft 22*a*.

The compression mechanism 3 is configured as described hereunder. To a lower end of the bearing member 5, a cylinder block 31 is secured. In a cylinder bore 31*a* formed in the cylinder block 31, a piston 32 is fitted. The piston 32 and the eccentric portion 22*b* are connected to each other by a connecting rod 34 via a piston pin 33.

To an end face of the cylinder block 31 on the opposite side of the eccentric portion 22*b*, a cylinder head 36 is secured via a valve plate 35.

To the valve plate 35, a suction valve and a discharge valve (not illustrated) of a reed valve structure, and the like, are attached at a location facing an end face of the piston 32.

Between the cylinder head 36 and the valve plate 35, a suction muffler 7 having the following structure is disposed.

As illustrated in FIGS. 3 to 6 on an enlarged scale, the suction muffler 7 is provided with a plastic box body including an upper lid member 71 which has an open lower face, and a lower lid member 72 which has an open upper face. In an inner space defined by fitting the upper lid member 71 and the lower lid member 72, a filter (strainer) 73 is attached.

On a side wall of the upper lid member 71, engaging holes 71*a* are opened at plural portions (four portions in the embodiment illustrated in the figure). On a side wall of the lower lid member 72, claws (protrusions) 72*a* protruding outward are formed at portions corresponding to the engaging holes 71*a*.

Furthermore, the upper lid member 71 is formed to include a step in a manner that a cross sectional area of an upper portion thereof becomes smaller than that of a lower portion thereof.

Furthermore, an inner face of a lower side wall of the upper lid member 71 is joined and fitted to an outer face of the side wall of the lower lid member 72, to engage and secure the claws 72*a* and the engaging holes 71*a*. In this case, an upper end face of the lower lid member 72 abuts on the step of the upper lid member 71, and thus, the step acts as a stopper.

Then, a lower end of the side wall of the upper lid member 71 is formed to protrude below a lower face of a bottom wall of the lower lid member 72 when the upper lid member 71 and the lower lid member 72 are fitted as mentioned above.

To the bottom wall of the lower lid member 72, an introducing pipe and a leading-out pipe of a refrigerant are connected as described hereunder.

A rubber bush 72*c* is formed so that the bush 72*c* is fitted in an attaching hole 72*b* which is opened near one longitudinal end of the bottom wall of the lower lid member 72. To an inner peripheral surface of the bush 72*c*, an end of a metal refrigerant introducing pipe 8 penetrated through and attached to a wall of the casing 1 is press-fitted and connected.

Here, the hole diameter of the attaching hole 72*b* is defined to be greater than an outer diameter of the attaching portion of the bush 72*c* so that a gap is formed therebetween, so that the refrigerant introducing pipe 8 can be easily attached to the suction muffler 7 while some deviation of location can be permissible and deformation can be prevented.

In contrast, near a center portion of the bottom wall of the lower lid member 72, a refrigerant leading-out pipe 72*d*, which has square and cylindrical shape and protrudes downward from a portion positioned on a downstream side of the filter 73 and opposite to the inlet side of the refrigerant, is integrally formed and connected thereto.

Thus, as mentioned above, by forming the lower end of the side wall of the upper lid member 71 to protrude below the lower face of the bottom wall of the lower lid member 72 (below connecting portions of the refrigerant introducing pipe 8 and the refrigerant leading-out pipe 72*d*, each of which is connected to the suction muffler 7), an protruding portion 72*f* surrounding an outside of the connecting portions of the refrigerant introducing pipe 8 and the refrigerant leading-out pipe 72*d*, connected to the suction muffler 7, is provided.

The refrigerant leading-out pipe 72*d* is fitted between a cavity 36*a* formed downward from an upper face of the cylinder head 36, and the valve plate 35. In this case, the refrigerant leading-out pipe 72*d* can be positioned and attached to the cylinder head 36 by engaging a protrusion 72*e* formed to protrude from an outer wall of the refrigerant leading-out pipe 72*d* with an engaging hole 36*b* formed by inwardly recessing a part of cavity 36*a*.

A lower end of the cavity 36*a* communicates with a compression chamber via the suction valve of the valve plate 35.

In contrast, on the cylinder head 36, a refrigerant discharging hole 36*c*, one end of which communicates with the compression chamber via the discharge valve of the valve plate 35. To the other end of the refrigerant discharging hole 36*c*, one end of a metal refrigerant discharging pipe 9 is connected. The other end of the refrigerant discharging pipe 9 is connected to an inlet of a discharge muffler 10.

To a discharge port of the discharge muffler 10, an end of a metal refrigerant leading-out pipe 11 which penetrates through and is attached to the casing 1 is connected.

Next, operation of the compressor will be described.

When the motor 2 is energized, the rotor shaft 22*a* is integrally rotated with the rotor 22, and accordingly, a rotating motion of the eccentric portion 22*b* is converted into a reciprocating motion of the piston 32 via a motion of the connecting rod 34.

Thus, as the piston 32 moves rightward in FIG. 1, a displacement of the compression chamber increases, and accordingly, the suction valve is opened due to a generated negative pressure suction force, so that the refrigerant is drawn from an outside of the casing 1 (from an evaporator) into the compression chamber by passing through the refrigerant introducing pipe 8, the suction muffler 7, and the cavity 36*a*, and via the suction valve.

While the refrigerant passes through the suction muffler 7, the refrigerant is filtered by the filter 73, and suction noise level can be decreased by means of a noise reducing function of expansion and compression.

As the piston 32 moves leftward in FIG. 1, the displacement of the compression chamber decreases, and accordingly, the compressed refrigerant is discharged from the discharge valve and is led out from the refrigerant leading-out pipe 11 to a system (condenser) outside the casing 1 by passing through the refrigerant discharging hole 36*c*, the refrigerant discharging pipe 9, and the discharge muffler 10.

On the other hand, by the rotation of the eccentric portion 22*b*, centrifugal force (upward component of the centrifugal force) is generated at the inclined feed oil pipe 6 and the helical oil groove 22*d*, so that the stored oil OL is drawn into the feed oil pipe 6 by the force, and then, the stored oil OL is sprayed upward from the upper end of the rotor shaft 22*a* via the oil hole 22*c* and the oil groove 22*d*.

After the upwardly sprayed oil hits a top inside surface of the casing 1, the oil radially moves to a surrounding area, and some of the oil forms an oil droplet and drips down, followed by adhering to components disposed thereunder, and then, the droplet returns to the stored oil OL. By such circulation of the oil, each of the components can be lubricated and cooled.

Some of the oil dripping in this manner adheres to a surface of the upper lid member 71 of the suction muffler 7.

The oil adhering to the upper lid member 71 flows down along the surface of the side wall of the upper lid member 71, and then, when the oil reaches the lower end of the side wall, the oil forms an oil droplet and drips down.

In this case, the lower end of the side wall of the upper lid member 71 (the lower end of the protruding portion 72*f*) is positioned below the lower face of the bottom wall of the lower lid member 72 (below the connecting portions of the refrigerant introducing pipe 8 and the refrigerant leading-out pipe 72*d*, connected to the suction muffler 7). That is, since the lower face of the bottom wall of the lower lid member 72 is positioned above the lower end of the side wall of the upper lid member 71, the oil can be effectively prevented from moving upward from the lower end of the side wall of the upper lid member 71 to the lower face of the bottom wall of the lower lid member 72, and the oil can drip from the lower end of the side wall of the upper lid member 71.

Thus, by allowing the oil adhering to the suction muffler 7 to drip from the lower end of the side wall of the upper lid member 71 (the lower end of the protruding portion 72*f*), which surrounds the connecting portion of the refrigerant introducing pipe 8 connected to the suction muffler 7, the oil can be prevented from being drawn into the suction muffler 7.

In particular, as mentioned above, since the bush-attaching hole and the bush 72*c* are relatively loosely fitted with forming the gap therebetween in order to easily attach the refrigerant introducing pipe 8 to the suction muffler 7, for example, a suction negative pressure generated in the suction muffler 7 is transmitted to the gap. Thus, when the oil arrives near the gap, the oil may be easily drawn into the suction muffler 7 via the gap. However, according to the present embodiment, since the oil can drip from the lower end of the side wall of the upper lid member 71, thereby preventing the oil from moving into the gap, the oil can be effectively prevented from being drawn in via the gap.

Furthermore, since each of a joined face of the upper lid member 71 and the lower lid member 72, and a joined face of an outer wall face of the refrigerant leading-out pipe 72*d* of the lower lid member 72 and an inner wall face of the cavity 36*a* of the cylinder head 36 is relatively tightly joined, the suction negative pressure transmitted to the joined faces is decreased. However, when the oil reaches these joined faces, the oil may be drawn into the suction muffler 7 via the joined faces. However, also in this case, since the oil drips from the lower end of the side wall of the upper lid member 71 (the lower end of the protruding portion 72*f*), which surrounds the connecting portion of the refrigerant leading-out pipe 72*d* connected to the suction muffler 7, thereby preventing the oil from arriving near the joined faces, the oil can be effectively prevented from being drawn via the joined faces.

Figure 7:
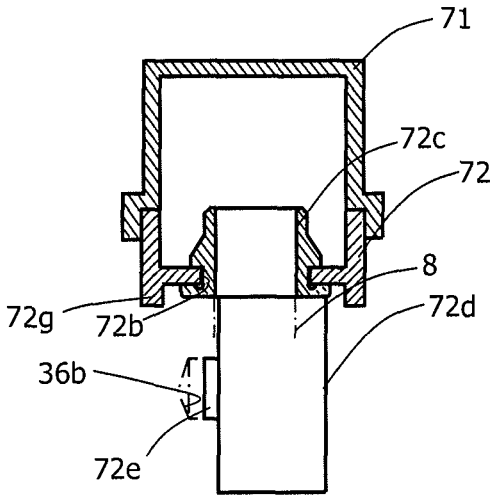
FIG. 7 is a cross-sectional view illustrating the main part of a muffler according to another embodiment of the present invention.

FIG. 7 illustrates another embodiment, in which an edge portion of the bottom wall of the lower lid member 72 protrudes downward, so that a protruding portion 72*g* surrounding the outside of the connecting portions of the refrigerant introducing pipe 8 and the refrigerant leading-out pipe 72*d*, connected to the suction muffler 7, is provided. The side wall of the upper lid member 71 is formed so that the height thereof becomes low, and the lower end thereof is positioned above the bottom wall of the lower lid member 72.

According to the present embodiment, the oil flowing down the side wall of the upper lid member 71 moves to the side wall of the lower lid member 72 and flows down this side wall, and then, when the oil flows down to the lower end of the protruding portion 72*g*, the oil drips down from the lower end of the protruding portion 72*g* while the oil is prevented from moving upward therefrom, and thus, the oil can be prevented from being drawn via the inlet or outlet of the refrigerant.

According to the present embodiment, although the lower end of the upper lid member 71 is positioned above the protruding portion 72*g*, the upper lid member 71 and the lower lid member 72 are tightly fitted and the inner face of the side wall of the upper lid member 71 is joined to the outer face of the side wall of the lower lid member 72 in a manner that the joined end faces downward, and thus, the oil can be prevented from being drawn via the joined portion.

Furthermore, according to the present embodiment, the protruding portion 72*g* is provided by forming the edge portion of the bottom wall to protrude downward; however, a protruding portion which surrounds the outside of the connecting portions of the refrigerant introducing pipe 8 and the refrigerant leading-out pipe 72*d*, connected to the suction muffler 7, may be provided inside the edge portion.

In this embodiment, the lower end of the side wall of the upper lid member 71 is positioned below a lower end of the bush 72*c*. However, it is found that even when the lower end of the bush 72*c* is positioned below the lower end of the side wall of the upper lid member 71, the effect of preventing the oil from being drawn into the suction muffler can also be achieved without a change.

Furthermore, the oil can also be effectively prevented from being drawn via a gap between the engaging hole 71*a* and the claws 72*a* since the gap is small.

As described above, since the oil can be effectively prevented from being drawn into the suction muffler 7, the increase in the temperature of the refrigerant gas can be prevented, and finally, the decrease in the refrigeration capacity due to the decrease in the density of the refrigerant can be prevented, and furthermore, the insufficient lubrication in the driving unit of the compressor or the insufficient cooling of the drive circuit caused by a shortage of the oil in the compressor due to the escape of the oil to the outside of the compressor, and finally, decrease in performance and reliability, can be avoided.

Furthermore, the suction muffler 7 does not require an extra component for preventing the oil from being drawn in, and the upper lid member 71 and the lower lid member 72 can be easily secured only by fitting each other, so that the welding machine and the welding process are also unnecessary. Thus, the suction muffler 7, which can be easily manufactured at lower cost, can achieve the effect of effectively preventing oil from being drawn into the suction muffler 7, as mentioned above.

The compressor to which the suction muffler of the present invention is applied is not limited to those described above according to the embodiments. The suction muffler of the present invention may be applied to any compressor in which the oil is sprayed from above and the suction muffler is disposed at a location at which the suction muffler can receive the sprayed oil.

REFERENCE SIGNS LIST

2 Motor
3 Compression mechanism
6 Feed oil pipe
7 Suction muffler
8 Refrigerant introducing pipe
22*a* Rotating shaft
22*b* Eccentric portion
22*c* Oil hole
22*d* Oil groove
71 Upper lid member
71*a* Engaging hole
72 Lower lid member
72*a* Claw
72*b* Bush-attaching hole
72*c* Bush
72*d* Discharging pipe
72*f*, 72*g* Protruding portions

The invention claimed is:

1. A suction muffler for a compressor, the suction muffler being disposed in a compressor casing at an inlet of a compression chamber on an upstream side of a refrigerant passage and disposed at a location at which the suction muffler receives oil sprayed from above in the casing, wherein an introducing pipe and a leading-out pipe of a refrigerant are connected upward to the suction muffler from beneath the suction muffler, and wherein at an outside of connecting portions of the introducing pipe and the leading-out pipe of the refrigerant, each of which is connected to the suction muffler, a protruding portion which protrudes below the connecting portions and surrounds the connecting portions is provided, the suction muffler comprising:

an upper lid member which has an open lower face; and a lower lid member which has an open upper face and a bottom wall to which the introducing pipe and the leading-out pipe of the refrigerant are connected, wherein an inner face of a side wall of the upper lid member is joined to an outer face of a side wall of the lower lid member, to be fitted and secured thereto, and wherein the protruding portion is provided by forming a lower end of the side wall of the upper lid member to protrude below a downward facing surface of the bottom wall of the lower lid member connected with the introducing pipe and the leading-out pipe of the refrigerant.

2. The suction muffler for the compressor according to claim 1, wherein the upper lid member and the lower lid member are secured by engaging a protrusion formed on one of the side walls and an engaging hole formed on the other of the side walls.

3. The suction muffler for the compressor according to claim 1, wherein to an attaching hole which is formed to penetrate through the bottom wall of the lower lid member, a rubber bush is attached, and an end of the refrigerant introducing pipe disposed to penetrate through the casing is press-fitted and attached in an inner peripheral surface of the bush.

4. A suction muffler for a compressor, the suction muffler being disposed in a compressor casing at an inlet of a compression chamber on an upstream side of a refrigerant passage and disposed at a location at which the suction muffler receives oil sprayed from above in the casing, wherein an introducing pipe and a leading-out pipe of a refrigerant are connected upward to the suction muffler from beneath the suction muffler, and wherein at an outside of connecting portions of the introducing pipe and the leading-out pipe of the refrigerant, each of which is connected to the suction muffler, a protruding portion which protrudes below the connecting portions and surrounds the connecting portions is provided, the suction muffler comprising:

an upper lid member which has an open lower face; and a lower lid member which has an open upper face and a bottom wall to which the introducing pipe and the leading-out pipe of the refrigerant are connected, wherein an inner face of a side wall of the upper lid member is joined to an outer face of a side wall of the lower lid member, to be fitted and secured thereto, and wherein the protruding portion is provided on a bottom wall of the lower lid member to protrude below a downward facing surface of the bottom wall connected with the introducing pipe and the leading-out pipe of the refrigerant.

5. The suction muffler for the compressor according to claim 4, wherein the upper lid member and the lower lid member are secured by engaging a protrusion formed on one of the side walls and an engaging hole formed on the other of the side walls.

6. The suction muffler for the compressor according to claim 4, wherein to an attaching hole which is formed to penetrate through the bottom wall of the lower lid member, a rubber bush is attached, and an end of the refrigerant introducing pipe disposed to penetrate through the casing is press-fitted and attached at an inner peripheral surface of the bush.

* * * * *